US010562678B2

(12) United States Patent
Byron et al.

(10) Patent No.: US 10,562,678 B2
(45) Date of Patent: Feb. 18, 2020

(54) BOTTLE CAP AND FITMENT ASSEMBLY AND METHOD

(71) Applicant: Kent Byron, New Iberia, LA (US)

(72) Inventors: Kent Byron, Lafayette, LA (US); Jason Burroughs, Tampa, FL (US)

(73) Assignee: Kent Byron, New Iberia, LA (US)

( * ) Notice: Subject to any disclaimer, the term of this patent is extended or adjusted under 35 U.S.C. 154(b) by 0 days.

(21) Appl. No.: 15/815,214

(22) Filed: Nov. 16, 2017

(65) Prior Publication Data

US 2019/0144169 A1 May 16, 2019

(51) Int. Cl.
*B65D 41/04* (2006.01)
*B65D 51/20* (2006.01)
*B65D 47/06* (2006.01)

(52) U.S. Cl.
CPC ..... *B65D 41/0457* (2013.01); *B65D 41/0435* (2013.01); *B65D 47/06* (2013.01)

(58) Field of Classification Search
CPC ..... B65D 50/041; B65D 41/0457; B65D 51/247; B65D 51/18; B65D 51/20; A61B 19/0288; B65B 7/2835
USPC ..... 215/220, 316
See application file for complete search history.

(56) References Cited

U.S. PATENT DOCUMENTS 4,273,248 A * 6/1981 Lehmann ..... B65D 41/0478 215/331
5,027,954 A * 7/1991 Hickerson ..... B65D 50/04 215/201
8,857,638 B2 * 10/2014 Brozell ..... B65D 50/041 215/219

* cited by examiner

*Primary Examiner* — Anthony D Stashick
*Assistant Examiner* — Raven Collins
(74) *Attorney, Agent, or Firm* — Jones Walker LLP

(57) ABSTRACT

A cap assembly for a bottle including a cap and a fitment. The cap includes a tubular side wall extending from an upper lateral wall to an open lower end. An inner surface of the tubular side wall includes a thread. An inner surface of the upper lateral wall includes a retaining extension. The fitment includes a side wall extending from an upper lateral surface to an open lower end. The upper lateral surface of the fitment includes a central aperture having a shape that is reciprocal to a shape of the retaining extension of the cap. The fitment is selectively secured within the cap by directly engaging the central aperture of the fitment with the retaining extension of the cap. The cap and fitment of the cap assembly are secured to a bottle simultaneously. The cap is threadedly secured on the bottle, thereby securing the fitment to the bottle.

18 Claims, 6 Drawing Sheets

BOTTLE CAP AND FITMENT ASSEMBLY AND METHOD

BACKGROUND

Most fitments are formed of disc-shaped members each having one or more apertures. The fitment is secured to the neck of a bottle to reduce the size of the bottle's opening. Conventional caps are secured to bottles over fitments, typically by threaded connection between the cap and the bottle.

A packaging business usually obtains the bottles, the fitments, and the caps each as separate components. The packaging business first fills the bottle with a product, then secures the fitment to the bottle, and subsequently threads the cap onto the bottle over the fitment.

DETAILED DESCRIPTION OF SELECTED EMBODIMENTS

A cap assembly for a bottle includes a cap and a fitment. The cap includes a retaining extension configured to engage a central aperture of the fitment to selectively secure the fitment within an inner cavity of the cap. The cap and the fitment of the cap assembly may be secured to the bottle simultaneously. The cap is threadedly secured on the bottle, thereby securing the fitment to the bottle. This single step assembly process saves a packaging business time, resulting in reduced costs. When the cap is subsequently removed (e.g., by a customer), the fitment remains secured to the bottle.

Figure 1:
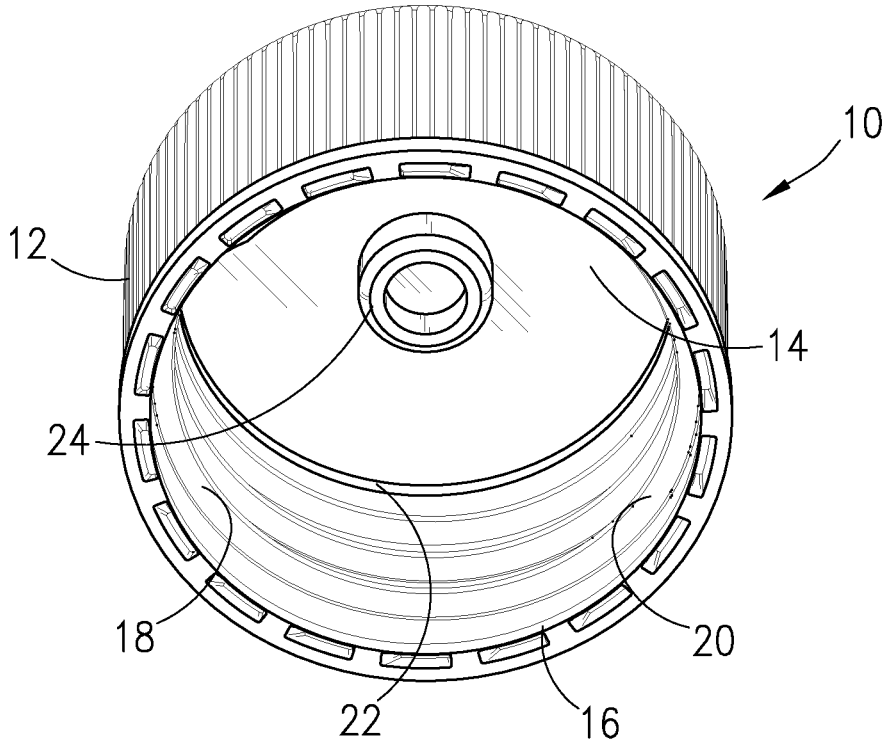
FIG. 1 is a bottom perspective view of a cap for a bottle.

With reference to FIG. 1, cap 10 includes tubular side wall 12 extending from upper lateral wall 14 to lower open end 16. Inner surface 18 of tubular side wall 12 includes thread 20. Inner surface 18 may also include straight profile portion 22 proximate upper lateral wall 14. The inner surface of upper lateral wall 14 includes retaining extension 24. Retaining extension 24 extends from upper lateral wall 14 into the inner cavity of cap 10. In one embodiment, retaining extension 24 extends from upper lateral wall 14 beyond straight profile portion 22. In one embodiment, an outer surface of tubular side wall 12 may include ribs. Alternatively, the outer surface of tubular side wall 12 may have a smooth profile.

Figure 2:
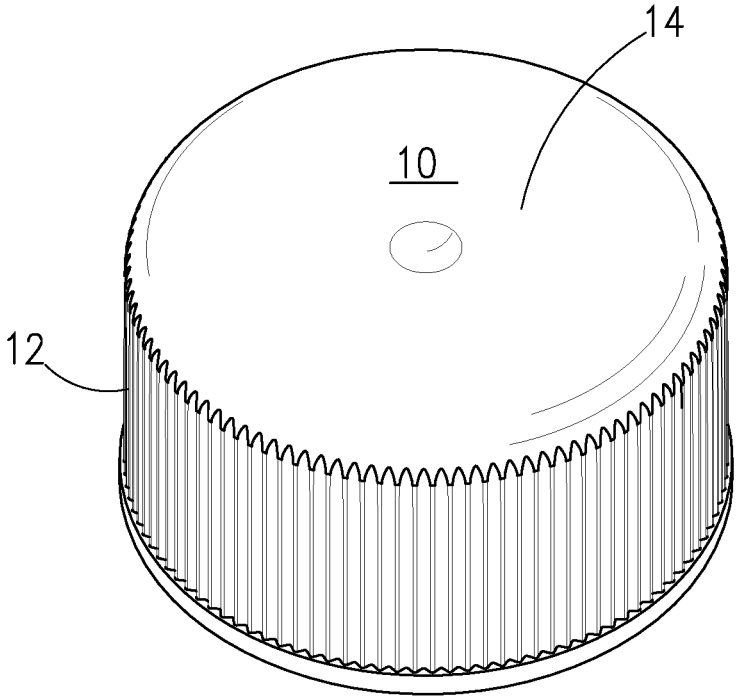
FIG. 2 is a top perspective view of the cap.

As shown in FIG. 2, upper lateral wall 14 may include a smooth surface. A beveled or curved edge may be formed at the intersection of tubular side wall 12 and upper lateral wall 14.

Figure 3:
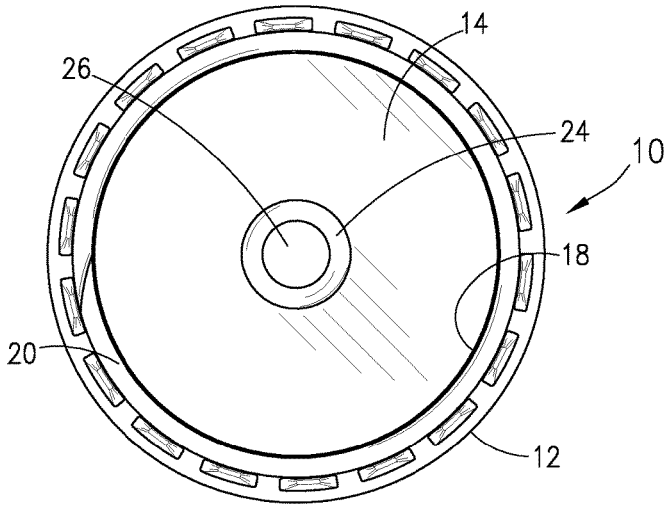
FIG. 3 is a bottom view of the cap.

With reference to FIG. 3, retaining extension 24 may have a circular shape with a central void 26. In other embodiments, retaining extension 24 may be solid across the width of retaining extension 24 with no void. In other embodiments, retaining extension 24 may have another shape, including but not limited to oval, triangular, square, rectangular, pentagonal, and hexagonal. Thread 20 extends from inner surface 18 of tubular side wall 12 into the inner cavity of cap 10.

Cap 10 may be formed of any durable and flexible material. For example, cap 10 may be formed of polypropylene. Cap 10 may have a diameter between 10 and 48 mm, or any subrange therein, and a height between 10 and 30 mm, or any subrange therein.

Figure 4:
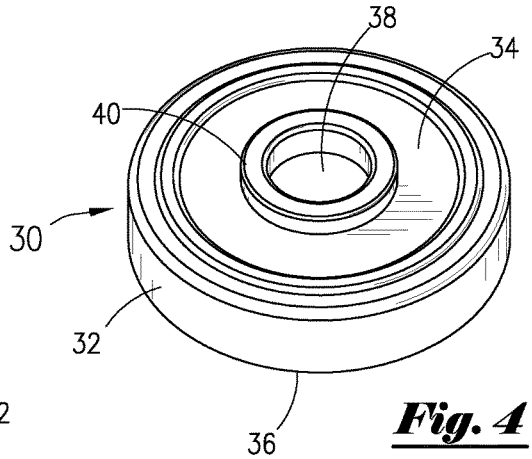
FIG. 4 is a top perspective view of a fitment.

FIG. 4 illustrates fitment 30, which includes side wall 32 extending from upper lateral surface 34 to lower end 36. Upper lateral surface 34 includes central aperture 38. In certain embodiments, aperture extension 40 may be disposed immediately adjacent to central aperture 38.

Figure 5:
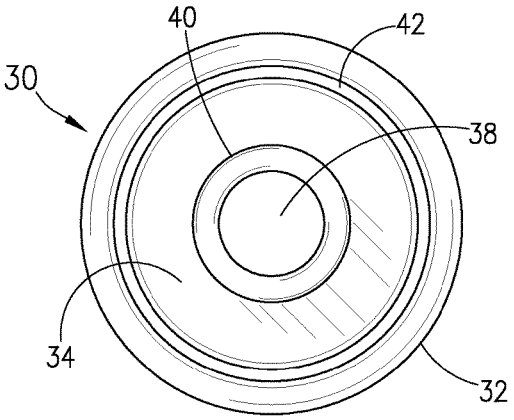
FIG. 5 is a top view of the fitment.

With reference to FIG. 5, aperture extension 40 may have the same shape as central aperture 38. Central aperture 38 may be round (i.e., a circular shape) as shown in FIG. 5. Alternatively, central aperture 38 may have any other shape, including but not limited to oval, triangular, square, rectangular, pentagonal, and hexagonal. In one embodiment, central aperture 38 and aperture extension 40 of fitment 30 may each have a shape that matches or is reciprocal to the shape of retaining extension 24 of cap 10.

Upper lateral surface 34 may further include secondary extension 42 disposed between central aperture 38 and side wall 32. Secondary extension 42 may have the same general shape as central aperture 40, or any other shape. In one embodiment, as shown, secondary extension 42 may have a circular shape. When fitment 30 is secured to a bottle, secondary extension 42 may provide a fluid seal against upper lateral wall 14 of cap 10.

Figure 6:
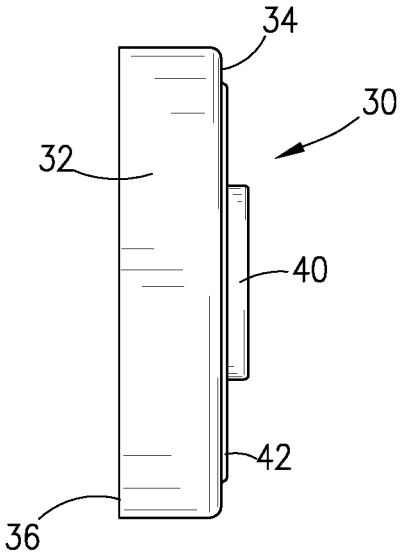
FIG. 6 is a side view of the fitment.

Referring now to FIG. 6, fitment 30 may be generally disc shaped as shown. Alternatively, fitment 30 may have any other shape, including but not limited to a tubular shape. Aperture extension 40 and secondary extension 42 may each extend beyond upper lateral surface 34 in a direction opposite side wall 32. In one embodiment, aperture extension 40 may extend beyond secondary extension 42 (i.e., aperture extension 40 has a height that is greater than a height of secondary extension 42). In certain embodiments, aperture extension 40 may have a height that is approximately the same as a height of retaining extension 24 of cap 10.

Figure 7:
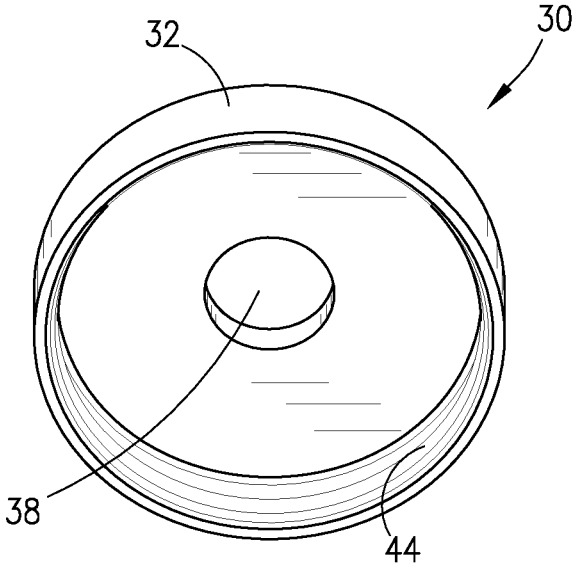
FIG. 7 is a bottom perspective view of the fitment.

With reference to FIG. 7, an inner surface of side wall 32 of fitment 30 may include inner shoulder 44 for engaging an outer shoulder of a bottle (not shown). In one embodiment, inner shoulder 44 has a generally dome-shaped profile. In other embodiments, inner shoulder 44 may have a generally square or rectangular profile.

Fitment 30 may be formed of any durable and flexible material. For example, fitment 30 may be formed of polyethylene. Fitment 30 may have a diameter between 10 and 48 mm, or any subrange therein, and a height between 5 and 20 mm, or any subrange therein.

In alternate embodiments, fitment 30 may include more than one aperture and cap 10 may include more than one retaining extension each configured to engage one of the apertures in fitment 30 to selectively retain fitment 30 within cap 10.

Figure 8:
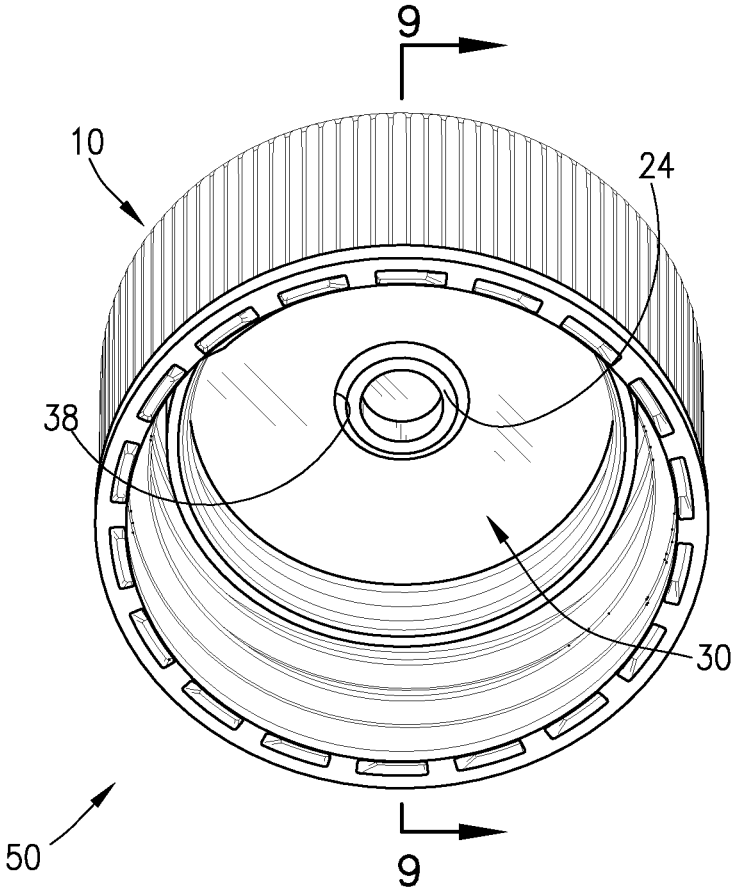
FIG. 8 is a bottom perspective view of the cap and the fitment in a cap assembly.

FIG. 8 illustrates cap assembly 50 including fitment 30 selectively secured within the inner cavity of cap 10. Specifically, retaining extension 24 of cap 10 is disposed through central aperture 38 of fitment 30. In one embodiment, aperture extension 40 of fitment 30 directly engages retaining extension 24 of cap 10. For example, an inner surface of aperture extension 40 of fitment 30 may directly engage an outer surface of retaining extension 24 of cap 10.

Figure 9:
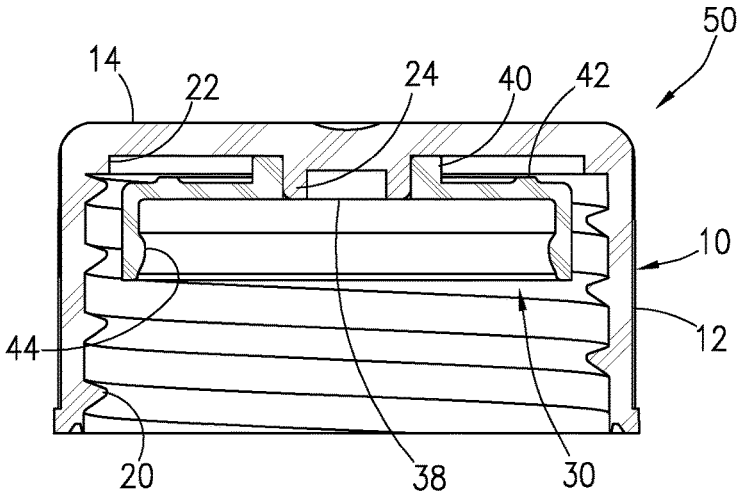
FIG. 9 is a sectional view of the cap assembly taken along line 9-9 in FIG. 8.

With reference to FIG. 9, fitment 30 may be disposed within straight profile portion 22 of cap 10. Fitment 30 is retained within cap 10 by retaining extension 24 of cap 10 engaging aperture extension 40 of fitment 30.

Figure 10:
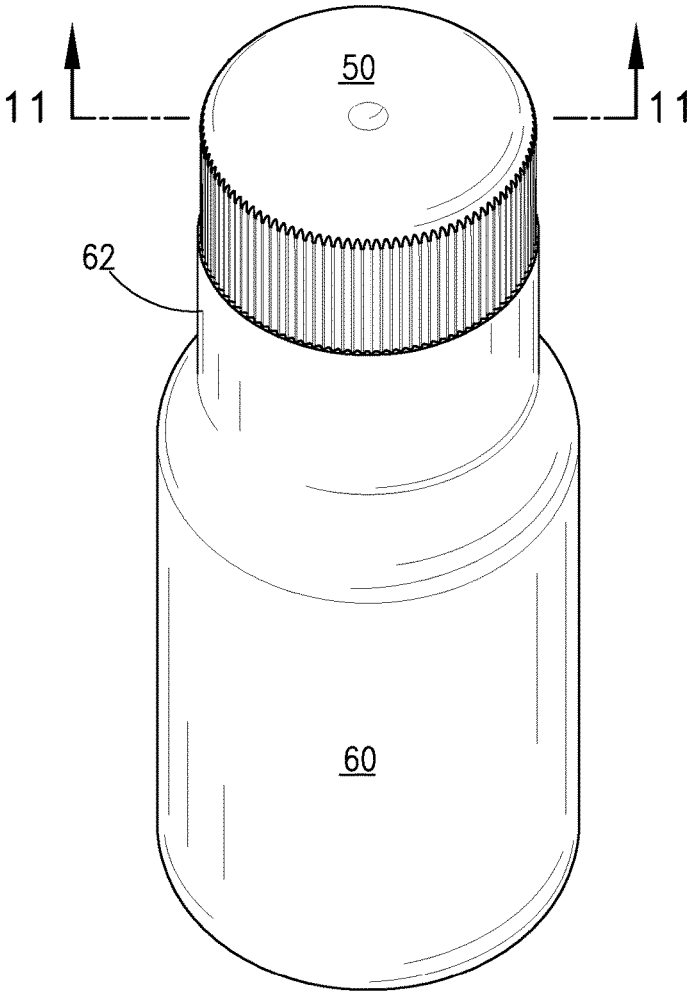
FIG. 10 is a perspective view of the cap assembly attached to a bottle.
Figure 11:
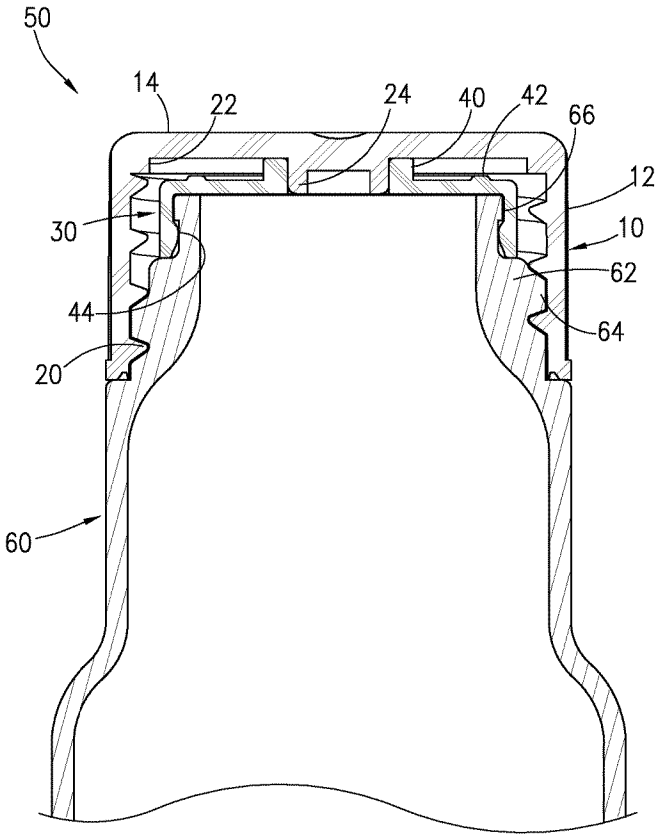
FIG. 11 is a sectional view of the cap assembly attached to the bottle taken along line 11-11 in FIG. 10.

As shown in FIGS. 10 and 11, bottle 60 may include neck portion 62 having threads 64. The upper end of bottle 60 may include outer shoulder 66 (or lip). Cap assembly 50 may be threadedly attached to bottle 60. As thread 20 of cap 10 slides along thread 64 of bottle 60, outer shoulder 66 of bottle 60 may engage inner shoulder 44 of fitment 30. In this way fitment 30 is secured to the upper end of bottle 60.

Figure 12:
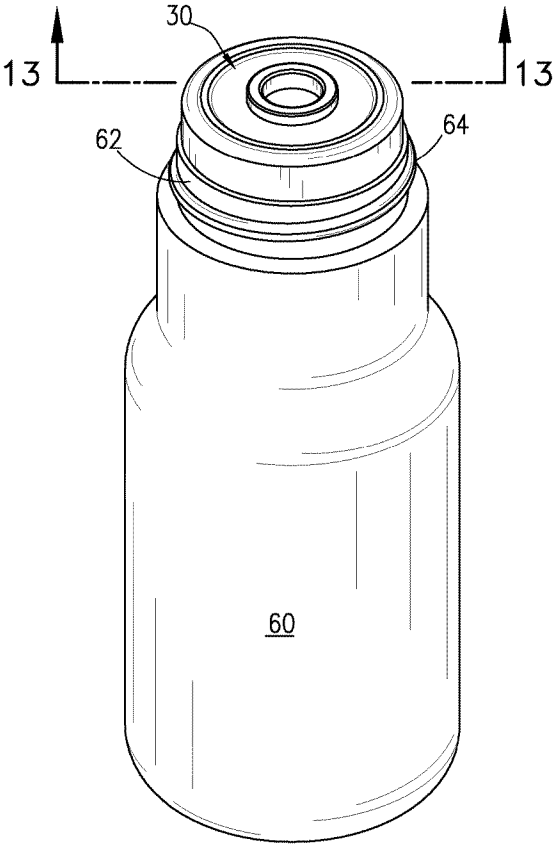
FIG. 12 is a perspective view of the fitment attached to the bottle after the cap is removed.
Figure 13:
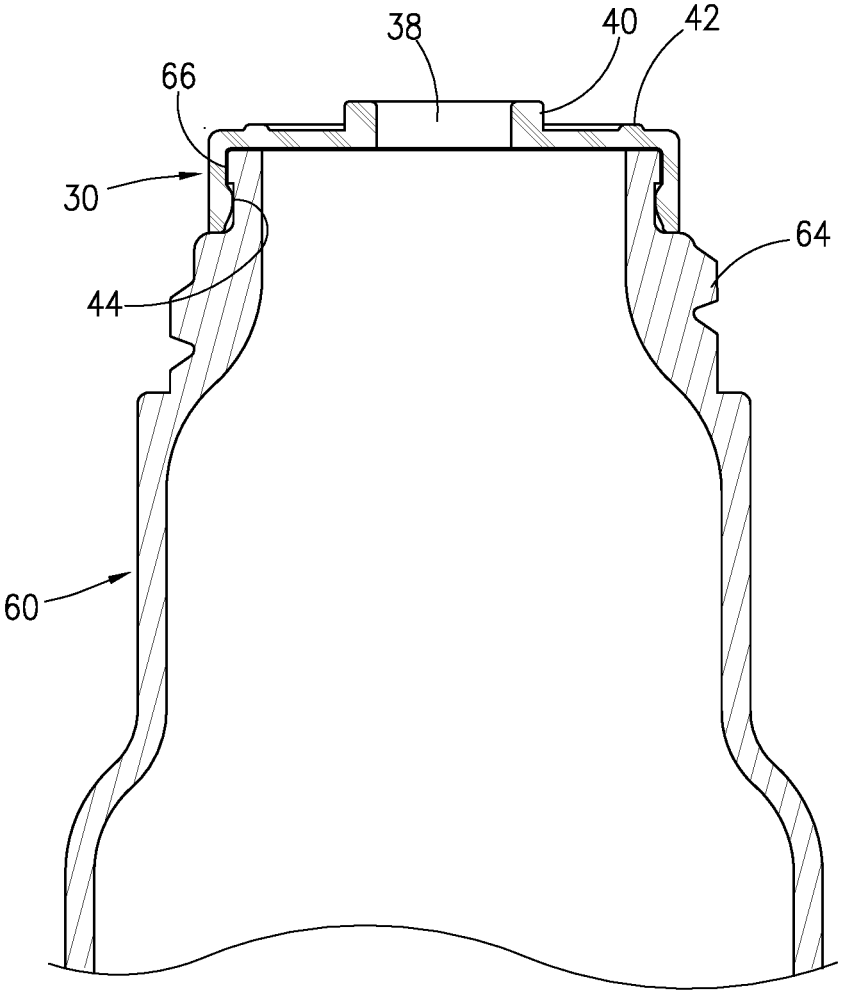
FIG. 13 is a sectional view of the fitment attached to the bottle taken along line 13-13 in FIG. 12.

When cap 10 is removed from bottle 60, outer shoulder 66 of bottle 60 retains inner shoulder 44 of fitment 30 to retain fitment 30 on bottle 60 as shown in FIGS. 12 and 13. Retaining extension 24 releases fitment 30 when outer shoulder 66 of bottle 60 engages inner shoulder 44 of fitment 30.

Each assembly described in this disclosure may include any combination of the described components, features, and/or functions of each of the individual assembly embodiments. Each method described in this disclosure may include any combination of the described steps in any order, including the absence of certain described steps and combinations of steps used in separate embodiments. Any range of numeric values disclosed herein shall be construed to include any subrange therein.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. A cap assembly for a bottle, comprising:

a cap including a tubular side wall extending from an upper lateral wall to an open lower end, wherein an inner surface of the tubular side wall includes a thread, and wherein an inner surface of the upper lateral wall includes a retaining extension; and a fitment selectively secured to the cap, the fitment including a side wall extending from an upper lateral surface to an open lower end, wherein the upper lateral surface includes a central aperture having a shape that is reciprocal to a shape of the retaining extension of the cap, and wherein the retaining extension of the cap extends within the central aperture of the fitment for securing the fitment within the cap;

wherein the fitment further includes an aperture extension surrounding the central aperture; and wherein the upper lateral surface of the fitment further includes a secondary extension disposed between and separate from the aperture extension and an outer edge of the upper lateral surface, wherein the secondary extension forms a continuous fluid seal against the upper lateral wall of the cap.

2. The cap assembly of claim 1, wherein the inner surface of the tubular side wall of the cap further includes a straight profile portion proximate the upper lateral wall, wherein the fitment is disposed at least partially within the straight profile portion of the cap.

3. The cap assembly of claim 2, wherein the side wall of the fitment includes an inner shoulder for engaging an outer shoulder of a bottle.

4. The cap assembly of claim 3, wherein the fitment further includes an aperture extension surrounding the central aperture, and wherein the retaining extension of the cap also directly engages the aperture extension of the fitment for securing the fitment within the cap.

5. The cap assembly of claim 4, wherein the central opening and the aperture extension of the fitment and the retaining extension of the cap each has a generally circular shape.

6. The cap assembly of claim 4, wherein the upper lateral surface of the fitment further includes a secondary extension disposed between the aperture extension and an outer edge of the upper lateral surface.

7. The cap assembly of claim 6, wherein a height of the aperture extension is greater than a height of the secondary extension.

8. A method of assembling a cap and a fitment with a bottle, comprising the steps of:

a) providing a cap assembly comprising: a cap and a fitment selectively secured to the cap, wherein the cap includes a tubular side wall extending from an upper lateral wall to an open lower end, wherein an inner surface of the tubular side wall includes a thread, wherein an inner surface of the upper lateral wall includes a retaining extension; wherein the fitment includes a side wall extending from an upper lateral surface to an open lower end, wherein the upper lateral surface includes a central aperture having a shape that is reciprocal to a shape of the retaining extension of the cap, wherein the side wall of the fitment includes an inner shoulder, and wherein the retaining extension of the cap extends within the central aperture of the fitment for securing the fitment within the cap; and b) attaching the cap assembly to a bottle by threadedly engaging the thread of the cap on an outer threaded surface of the bottle and engaging the inner shoulder of the fitment on an outer shoulder of the bottle;

wherein in step (a) the fitment further includes an aperture extension surrounding the central aperture, wherein the upper lateral surface of the fitment further includes a secondary extension disposed between and separate from the aperture extension and an outer edge of the upper lateral surface, wherein the secondary extension forms a continuous fluid seal against the upper lateral wall of the cap; and wherein step (b) further includes engaging the secondary extension with the upper lateral wall of the cap to form a continuous fluid seal.

9. The method of claim 8, wherein in step (a) the inner surface of the tubular side wall of the cap further includes a straight profile portion proximate the upper lateral wall, and wherein the fitment is disposed at least partially within the straight profile portion of the cap.

10. The method of claim 9, wherein in step (a) the fitment further includes an aperture extension surrounding the central aperture, and wherein the retaining extension of the cap also directly engages the aperture extension of the fitment for securing the fitment within the cap.

11. The method of claim 10, wherein in step (a) the central opening and the aperture extension of the fitment and the retaining extension of the cap each has a generally circular shape.

12. The method of claim 8, further comprising the step of:

c) threadedly disconnecting the cap from the bottle, wherein the fitment is retained on the bottle by the outer shoulder of the bottle engaging the inner shoulder of the fitment.

13. A method of assembling a cap assembly, comprising the steps of:

a) providing a cap and a fitment, wherein the cap includes a tubular side wall extending from an upper lateral wall to an open lower end, wherein an inner surface of the tubular side wall includes a thread, wherein an inner surface of the upper lateral wall includes a retaining extension; wherein the fitment includes a side wall extending from an upper lateral surface to an open lower end, wherein the upper lateral surface includes a central aperture having a shape that is reciprocal to a shape of the retaining extension of the cap; and b) securing the fitment within the cap by extending the retaining extension of the cap within the central aperture of the fitment;

wherein in step (a) the fitment further includes an aperture extension surrounding the central aperture, wherein the upper lateral surface of the fitment further includes a secondary extension disposed between and separate from the aperture extension and an outer edge of the upper lateral surface, wherein the secondary extension forms a continuous fluid seal against the upper lateral wall of the cap; and wherein step (b) further includes engaging the secondary extension with the upper lateral wall of the cap to form a continuous fluid seal.

14. The method of claim 13, wherein in step (a) the inner surface of the tubular side wall of the cap further includes a straight profile portion proximate the upper lateral wall, and wherein in step (b) the fitment is at least partially disposed within the straight profile portion of the cap.

15. The method of claim 14, wherein in step (a) the fitment further includes an aperture extension surrounding the central aperture, and wherein in step (b) the retaining extension of the cap also directly engages the aperture extension of the fitment to secure the fitment within the cap.

16. The method of claim 15, wherein in step (a) the central opening and the aperture extension of the fitment and the retaining extension of the cap each has a generally circular shape.

17. The method of claim 8, wherein in step (a) a height of the aperture extension is greater than a height of the secondary extension.

18. The method of claim 13, wherein in step (a) a height of the aperture extension is greater than a height of the secondary extension.

* * * * *